US005744762A

United States Patent [19]

Seki et al.

[11] Patent Number: 5,744,762

[45] Date of Patent: Apr. 28, 1998

[54] MUFFLER CONTROLLER FOR USE IN CONTROLLABLE EXHAUST SYSTEM OF INTERNAL COMBUSTION ENGINE

[75] Inventors: Koji Seki, Yokohama; Yukio Nakanishi; Tanomo Norikawa, both of Yokosuka, all of Japan

[73] Assignee: Calsonic Corporation, Tokyo, Japan

[21] Appl. No.: 571,768

[22] Filed: Dec. 13, 1995

[30] Foreign Application Priority Data

Feb. 24, 1995 [JP] Japan ..... 7-036518

[51] Int. Cl.[6] ..... F01N 1/00

[52] U.S. Cl. ..... 181/254; 181/226; 137/493

[58] Field of Search ..... 181/226, 236, 181/237, 239, 254, 255, 265, 269; 60/312; 137/493, 513.3, 513.5, 560

[56] References Cited

U.S. PATENT DOCUMENTS

| | | | |
|---|---|---|---|
| 1,613,322 | 1/1927 | Goetz . | |
| 2,214,894 | 9/1940 | Wilson . | |
| 4,148,337 | 4/1979 | Ellmers | 137/493 |
| 4,866,933 | 9/1989 | Kao | 60/312 |
| 4,901,528 | 2/1990 | Saigo et al. | 60/312 |
| 4,913,260 | 4/1990 | Fallon | 181/254 |

FOREIGN PATENT DOCUMENTS

| | | |
|---|---|---|
| 2 110 000 | 11/1972 | Germany . |
| 94 13 493.6 | 11/1994 | Germany . |
| 3-185209 | 8/1991 | Japan . |

*Primary Examiner*—Khanh Dang
*Attorney, Agent, or Firm*—Foley & Lardner

[57] ABSTRACT

A controllable exhaust system of an internal combustion engine is shown which includes an exhaust gas inlet tube extending from the engine, a muffler connected at its inlet side to the exhaust gas inlet tube and having first and second exhaust gas flowing passages defined therein, and first and second exhaust gas outlet tubes respectively connected to the first and second exhaust gas flowing passages and extending from the muffler independently. A muffler controller is incorporated with the exhaust system for varying the flow passage area of the second exhaust gas outlet tube in accordance with the pressure of the exhaust gas led into the muffler from the engine. The muffler controller comprises an actuator having a piston rod which is moved straightly and reciprocatively in accordance with the magnitude of the exhaust pressure in the muffler; and a valve assembly including a valve plate, a pivot shaft through which the valve plate is pivotally installed in the second exhaust gas outlet tube, an operation disc coaxially connected to the pivot shaft to rotate together with the pivot shaft and the valve plate, an elongate slot formed in the operation disc and extending radially with respect to the center of the operation disc, and a roller rotatably connected to the piston rod and slidably received in the elongate slot.

8 Claims, 9 Drawing Sheets

MUFFLER CONTROLLER FOR USE IN CONTROLLABLE EXHAUST SYSTEM OF INTERNAL COMBUSTION ENGINE

BACKGROUND OF THE INVENTION

1. Field of the Invention

The present invention relates in general to exhaust systems of an automotive internal combustion engine and more particularly to the exhaust systems of a controllable type including a muffler which muffles the exhaust gas from the engine and a muffler controller which controls the performance of the muffler thereby controlling the pressure and sound of the exhaust gas. More specifically, the present invention is concerned with the muffler controllers of a type using a valve which varies the flow passage area of a gas flow path defined in the muffler.

2. Description of the Prior Art

One of the muffler controllers of the above-mentioned type is described in Japanese Patent First Provisional Publication 3-185209, which is shown in FIGS. 10, 11 and 12 of the accompanying drawings.

The controller comprises a valve assembly 100 and an actuator (not shown) for actuating the valve assembly 100. The valve assembly 100 is mounted to an auxiliary exhaust gas outlet tube 102 which extends from a muffler. The valve assembly 100 comprises a circular valve plate 104 which is pivotally installed in the tube 102 through a pivot shaft 106. The pivot shaft 106 has at its exposed part a drum 108 secured thereto. A wire 110 extending from the actuator is connected to a peripheral part of the drum 108, as is seen from FIG. 12. A biasing spring 112 is put around the drum 108 to bias the valve plate 104 toward a fully closed position. When, upon energization of the actuator, the wire 110 is pulled toward the actuator against the biasing spring 112, the valve plate 104 is pivoted from the fully closed position toward a fully opened position, that is, in a direction to increase the flow passage area of the tube 102.

However, the muffler controller using the above-mentioned valve assembly 100 has failed to exhibit a satisfied performance in smoothly controlling the muffler. That is, due to inherent construction of the valve assembly 100, it has sometimes occurred that the valve plate 104 assuming the fully closed position is accidently caught by the inner wall of the tube 102 and thus the valve plate 104 can not pivot any longer even if it is pulled by the wire 110. This undesired valve-holding phenomenon is caused by the thermal expansion of the tube 102 during operation of the engine. Furthermore, since, as is seen from FIG. 12, a stopper 114 secured to the pivot shaft 106 is employed for stopping the valve plate 104 at just the fully opened position, the valve assembly 100 is bulky in construction. The fully opened position of the valve plate 104 is effected by abutting the leading hook end of the stopper 114 against an inner wall of the tube 102.

SUMMARY OF THE INVENTION

It is therefore an object of the present invention to provide a muffler controller which is free of the above-mentioned drawbacks.

According to the present invention, there is provided a muffler controller including a valve assembly which can smoothly and assuredly vary the flow passage area of an exhaust gas outlet tube of a muffler in accordance with operation of an actuator.

According to the present invention, there is further provided a muffler controller including a valve assembly which is simple in construction, low in cost and compact in size.

According to a first aspect of the present invention, there is a muffler controller for use with a muffler installed in an exhaust system of an internal combustion engine. The muffler controller comprises means defining an exhaust flow passage through which the exhaust gas from the muffler flows before being discharged to the open air; an actuator having a piston rod which is moved straightly and reciprocatively in accordance with the magnitude of the exhaust pressure in the muffler; and a valve assembly including a valve plate, a pivot shaft through which the valve plate is pivotally installed in the exhaust flow passage, an operation disc coaxially connected to the pivot shaft to rotate together with the pivot shaft and the valve plate, means for defining an elongate slot which extends radially with respect to the center of the operation disc, and a roller rotatably connected to the piston rod and slidably received in the elongate slot.

According to a second aspect of the present invention, there is provided a muffler controller for use in a controllable exhaust system of an internal combustion engine. The exhaust system includes an exhaust gas inlet tube extending from the engine, a muffler connected at its inlet side to the exhaust gas inlet tube and having first and second exhaust gas flowing passages defined therein, and first and second exhaust gas outlet tubes respectively connected to the first and second exhaust gas flowing passages and extending from the muffler independently. The muffler controller varies the flow passage area of the second exhaust gas outlet tube in accordance with the pressure of the exhaust gas led into the muffler from the engine. The muffler controller comprises an actuator having a piston rod which is moved straightly and reciprocatively in accordance with the magnitude of the exhaust pressure in the muffler; and a valve assembly including a valve plate, a pivot shaft through which the valve plate is pivotally installed in the second exhaust gas outlet tube, an operation disc coaxially connected to the pivot shaft to rotate together with the pivot shaft and the valve plate, means for defining in the operation disc an elongate slot which extends radially with respect to the center of the operation disc, and a roller rotatably connected to the piston rod and slidably received in the elongate slot.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In order to clarify the muffler controller of the present invention, a controllable exhaust system of an internal combustion engine, to which the muffler controller is practically applied, will be briefly described with reference to the drawings.

Figure 2:
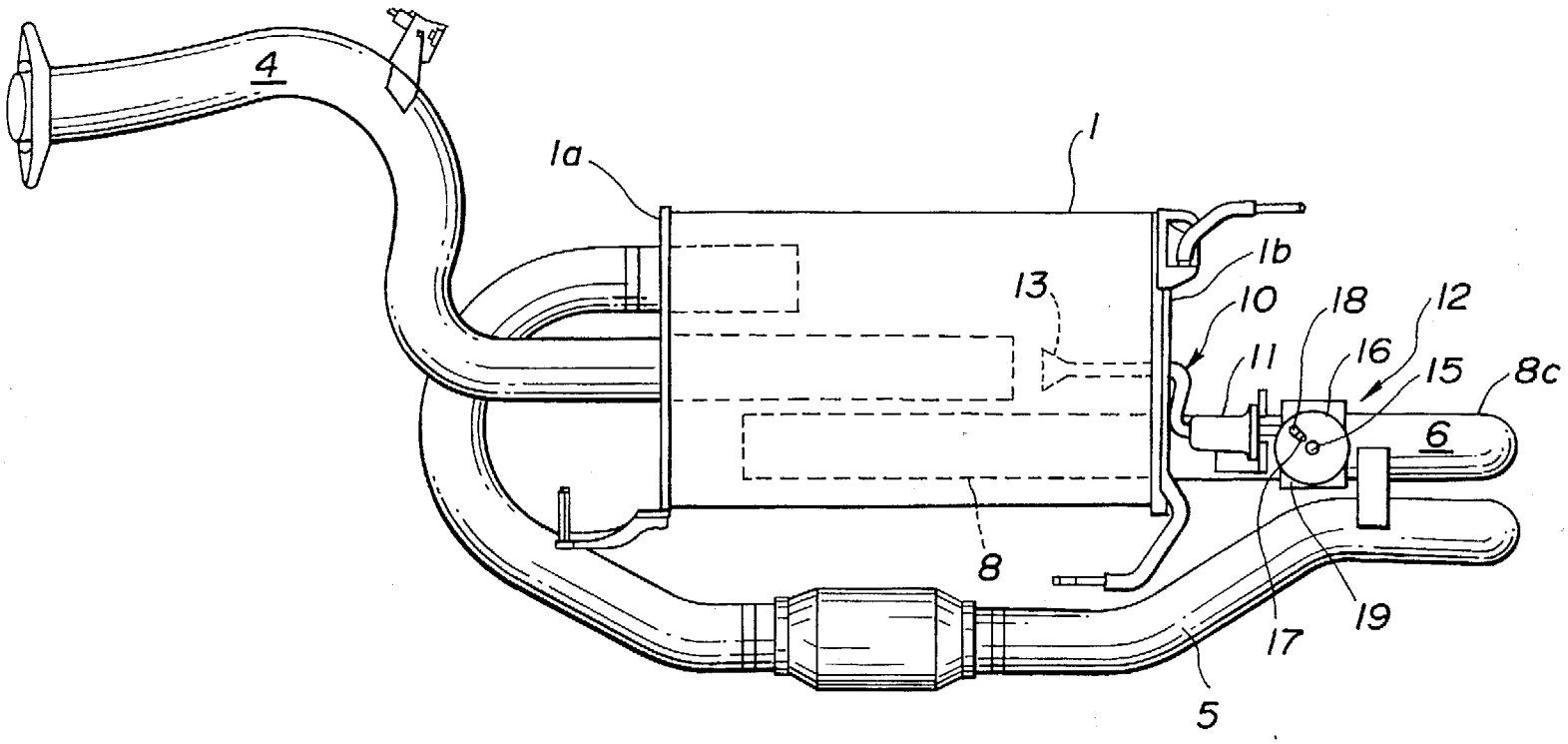
FIG. 2 is a view of a controllable exhaust system of an internal combustion engine to which the muffler controller of the invention is applied.
Figure 3:
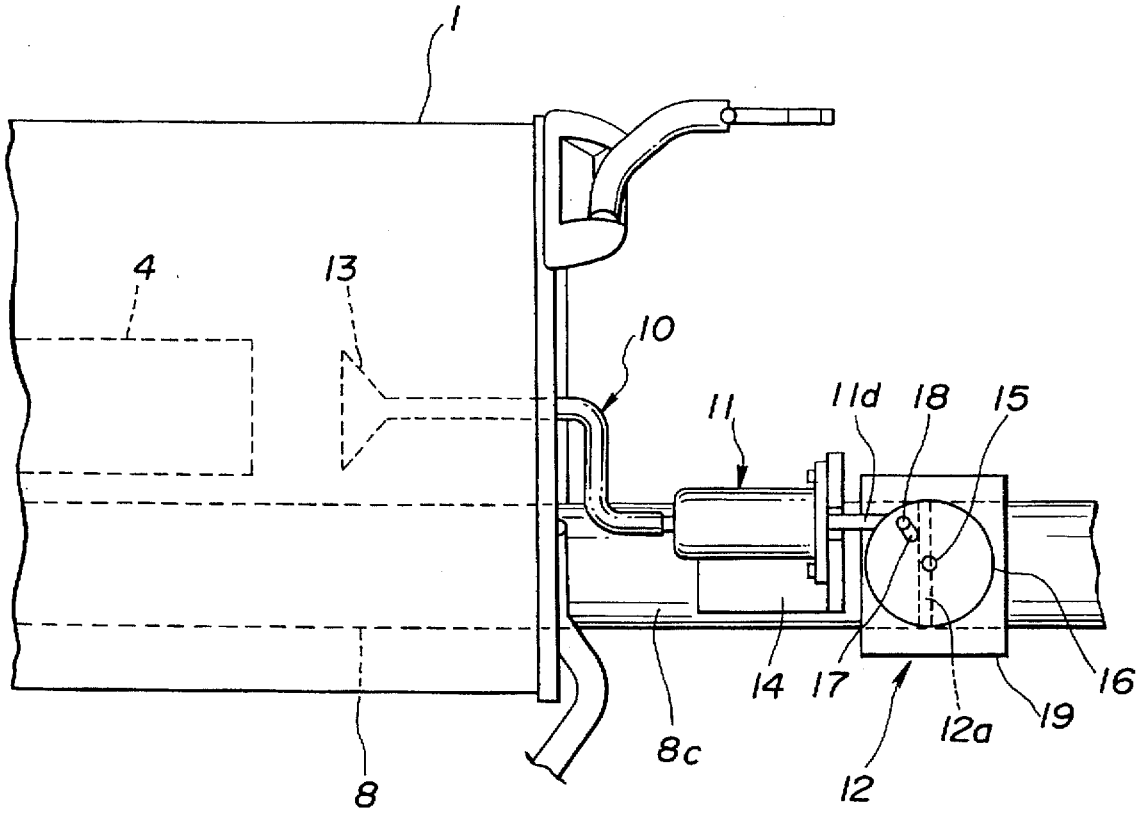
FIG. 3 is an enlarged view of an essential portion of the controllable exhaust system to which the muffler controller of the invention is practically applied.
Figure 4:
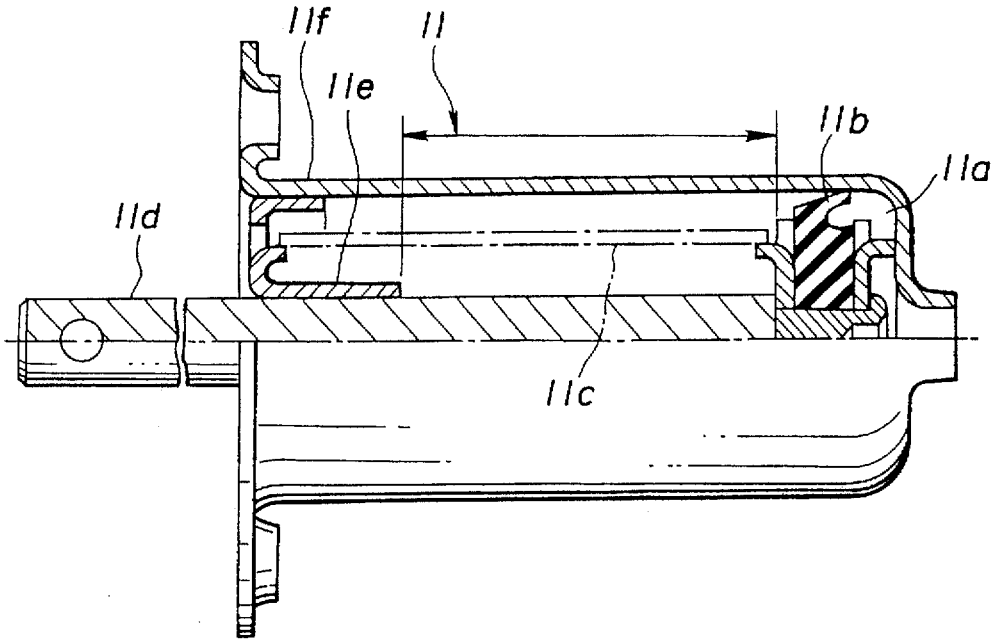
FIG. 4 is a partially sectioned view of a cylinder type actuator employed in the muffler controller of the invention.

Referring to FIGS. 2, 3 and 4, particularly FIGS. 2 and 3, the controllable exhaust system is shown.

In FIGS. 2 and 3, denoted by numeral 1 is an exhaust muffler. Although not shown, a plurality of partition walls are installed in the muffler to define therein a plurality of expansion and resonance chambers. Denoted by numeral 4 is an exhaust gas inlet tube which has a rear end portion projected into the muffler 1. A front end of the tube 4 is connected to an outlet port of a catalytic converter (not shown). First and second exhaust gas outlet tubes 5 and 8 extend from the interior of the muffler 1.

The first exhaust gas outlet tube 5 has a front end portion projected into the muffler 1 from a front wall 1*a* of the muffler 1. The second exhaust gas outlet tube 8 has a front half portion projected into the muffler 1 from a rear wall 1*b* of the muffler 1. A rear half portion 8*c* of the second exhaust tube 8 is exposed to the outside of the muffler 1, as shown.

Thus, within the muffler 1, there are defined two exhaust flow passages which are respectively associated with the first and second exhaust gas outlet tubes 5 and 8.

Denoted by numeral 10 is a pressure induction pipe, 11 is a cylinder type actuator and 12 is a valve assembly mounted to the second exhaust gas outlet tube 8, which constitute an improved muffler controller of the present invention, as will be described in detail in the following.

As is best shown in FIG. 3, the pressure induction pipe 10 has a tapered open end 13 led into the muffler 1. The tapered open end 13 faces a rear end of the exhaust gas inlet tube 4. The other open end of the pipe 10 is connected to the cylinder type actuator 11. Thus, a positive pressure consisting of static and dynamic pressures created in the muffler 1 is led into the actuator 11.

As is seen from FIG. 4, the actuator 11 comprises a cylindrical casing 11*f*, an annular piston 11*b* slidably received in the casing 11*f* to define a work chamber 11*a*, a coil spring 11*c* installed in the casing 11*f* to bias the annular piston 11*b* rightward in the drawing, a piston rod 11*d* extending from the annular piston 11*b* to the outside of the casing 11*f*, and a stopper 11*e* installed in the casing 11*f* to stop excessive displacement of the piston 11*b*. The inner surface of the cylindrical casing 11*f* is lined with a plastic to smooth the movement of the piston 11*b* in the casing 11*f*. The work chamber 11*a* is connected to the other open end of the pressure induction pipe 10. Thus, when the positive pressure is led into the work chamber 11*a* through the pipe 10, the piston 11*b* is slid leftward in FIG. 4 against the biasing force of the spring 11*c* thereby pushing out the piston rod 11*d*.

Referring back to FIG. 3, the cylinder type actuator 11 is mounted on a bracket 14 which is secured to the exposed rear half portion 8*c* of the second exhaust gas outlet tube 8. The piston rod 11*d* of the actuator 11 is operatively connected to the valve assembly 12 in such a manner as will be described in detail hereinafter.

The valve assembly 12 comprises a butterfly plate 12*a* pivotally installed through a pivot shaft 15 in the exposed rear half portion 8*c* of the second exhaust gas outlet tube 8. The pivot shaft 15 is operatively connected to the piston rod 11*d* of the actuator 11 through a unique link mechanism.

Figure 5:
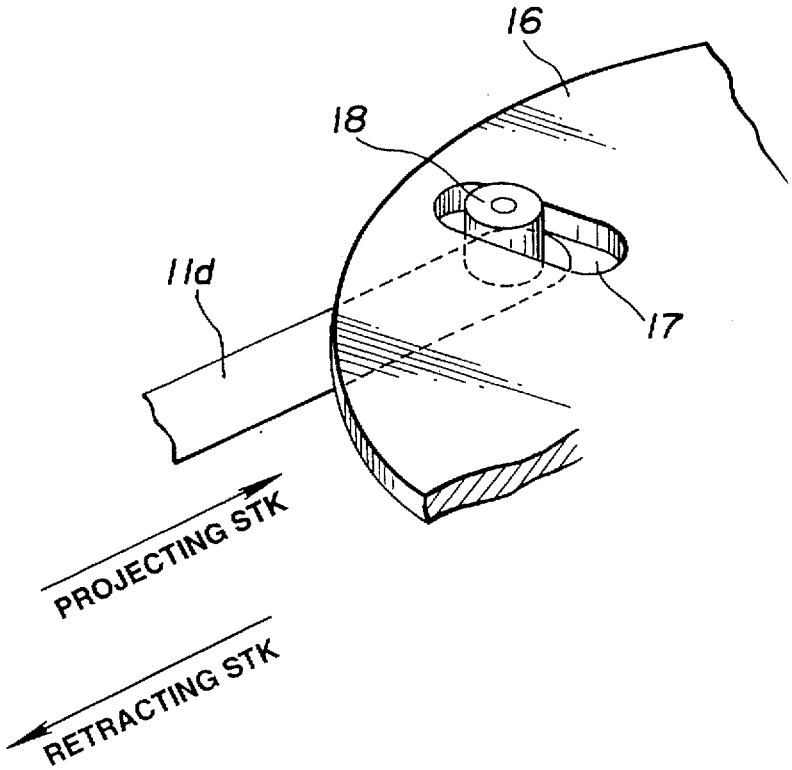
FIG. 5 is an enlarged, but partial, perspective view of a link mechanism employed in the invention.

As is well seen from FIGS. 3 and 5, the link mechanism comprises an operation disc 16 which is coaxially connected to the pivot shaft 15 to rotate therewith, and a roller 18 which is rotatably connected to the leading end of the piston rod 11*d* and slidably put in an elongate slot 17 formed in the operation disc 16.

The elongate slot 17 extends radially with respect to the center of the operation disc 16.

Figure 1:
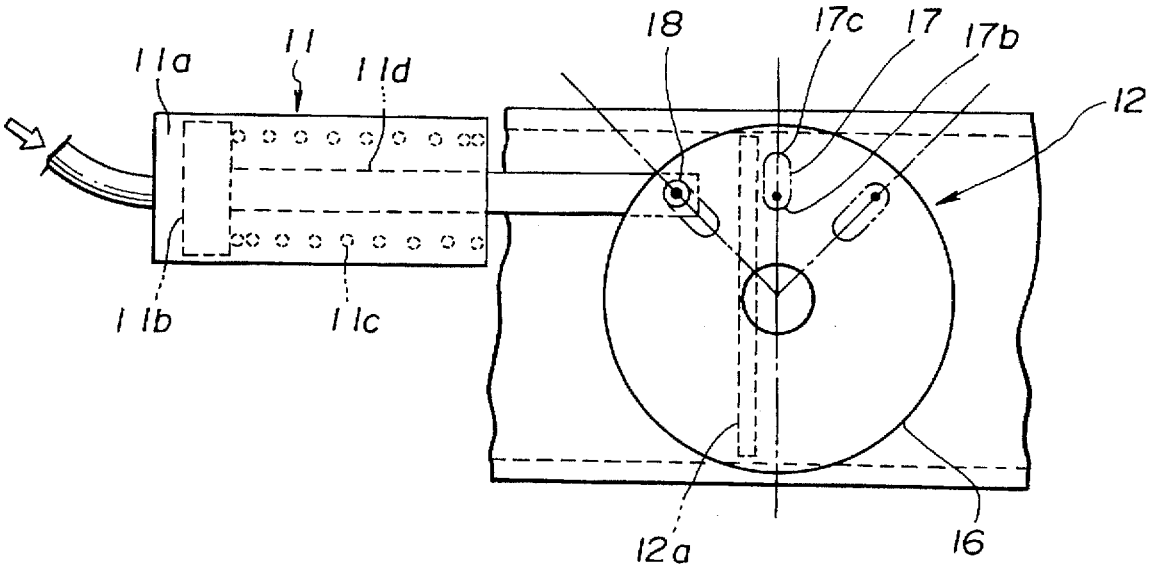
FIG. 1 is a sectional view of a muffler controller of the present invention.

As is understood from FIG. 1, the link mechanism is so arranged and set that when the piston rod 11*d* of the actuator 11 assumes its innermost position as shown in the drawing, the butterfly plate 12*a* of the valve assembly 12 assumes its fully closed position as shown in the drawing and when the piston rod 11*d* assumes its outermost position, the butterfly plate 12*a* assumes its fully opened position.

Figure 6A:
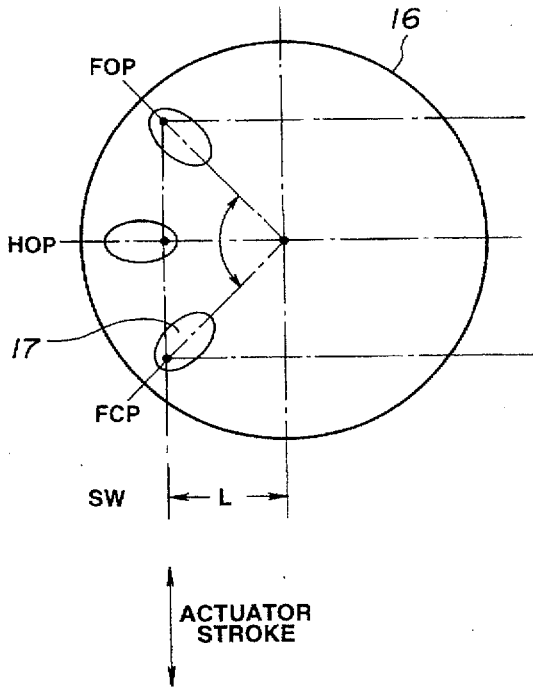
FIGS. 6A–B are drawings depicting the principle of a unique movement of an operation disc, which is achieved by the link mechanism employed in the invention.
Figure 6B:
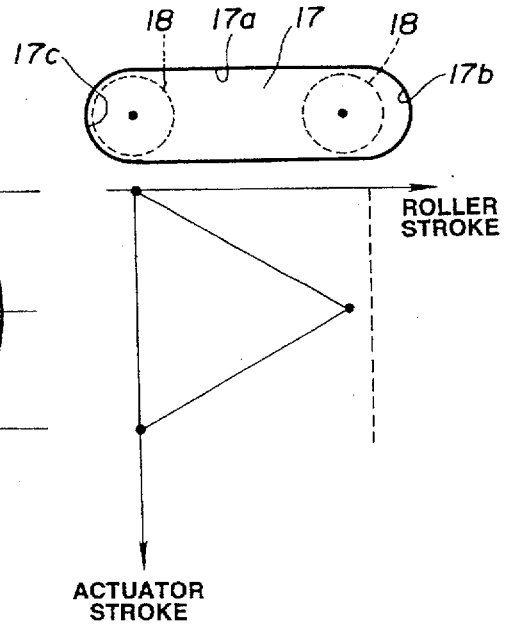

This connection is depicted in detail by FIGS. 6A–B.

That is, due to the straight-line motion of the piston rod 11*d* of the actuator 11, the roller 18 on the piston rod 11*d* makes a reciprocative movement along an imaginary straight-way "SW" which is offset from the center "O" of the operation disc 16 by a predetermined distance "L". The straight-way "SW" is perpendicular to the axis of the pivot shaft 15. For association with the motion of the roller 18, the elongate slot 17 of the operation disc 16 has a straight section 17*a* which permits the pivoting movement of the butterfly plate 12*a* from the fully closed position to the fully opened position and vice versa. That is, as is seen from FIGS. 6A–B and 1, when the piston rod 11*d* (or the roller 18) makes a straight-line motion from the innermost position to the outermost position, the roller 18 travels in the elongate slot 17 from an outer end 17*c* thereof to an inner end 17*b* thereof and to the outer end 17*c* thereof. That is, the roller 18 makes a round trip in the elongate slot 17 per each projecting or retracting stroke of the piston rod 11*d*. During this, the butterfly plate 12*a* is pivoted by 90° in angle from the fully closed position to the fully opened position or vice versa. For achieving a smoothly guided motion of the roller 18 in the elongate slot 17, the diameter of the roller 18 is somewhat smaller than the breadth of the slot 17.

In the following, operation of the controllable exhaust system, to which the muffler controller of the invention is practically applied, will be briefly described with respect to FIGS. 2 and 3.

For ease of understanding, the description will be commenced with respect to a standstill condition of the engine.

Under this rest condition, the butterfly valve 12*a* of the valve assembly 12 assumes the fully closed position. Thus, the flow passage of the second exhaust gas outlet tube 8 is fully closed.

When now the engine is started, the exhaust gas from the engine is fed into the muffler 1 through the exhaust gas inlet tube 4. During traveling in the exhaust flow passages of the muffler 1, the exhaust gas looses its energy.

When the depressing an a increased by depressing an accelerator pedal, the pressure of the exhaust gas is increased accordingly.

When the engine speed is further increased and comes a certain level, for example, about 1500 rpm, the increased pressure of the exhaust gas fed to the work chamber 11*a* of the actuator 11 starts to move the piston rod 11*d* against the biasing spring 11*c* in the direction to open the butterfly plate 12*a*. Upon this, the second exhaust gas outlet tube 8 becomes operative but partially. That is, in addition to the exhaust gas flow directed toward the first exhaust gas outlet tube 5, the muffler 1 produces another exhaust gas flow directed toward the second exhaust gas outlet tube 8.

When the engine speed is further increased and thus the pressure of the exhaust gas is further increased, the butterfly plate 12*a* increases its open degree. Thus, the resistance of the muffler 1 against the flow of the exhaust gas flowing therein is reduced.

The operation of the controllable exhaust system, to which the present invention is practically applied, will become much apparent from the following description.

OPERATION OF ACTUATOR 11

When, during operation of the engine, the exhaust gas is led into the work chamber 11*a* of the actuator 11 through the pressure induction pipe 10, the piston rod 11*d* of the actuator 11 is moved in accordance with the magnitude of the exhaust gas.

Figure 7:
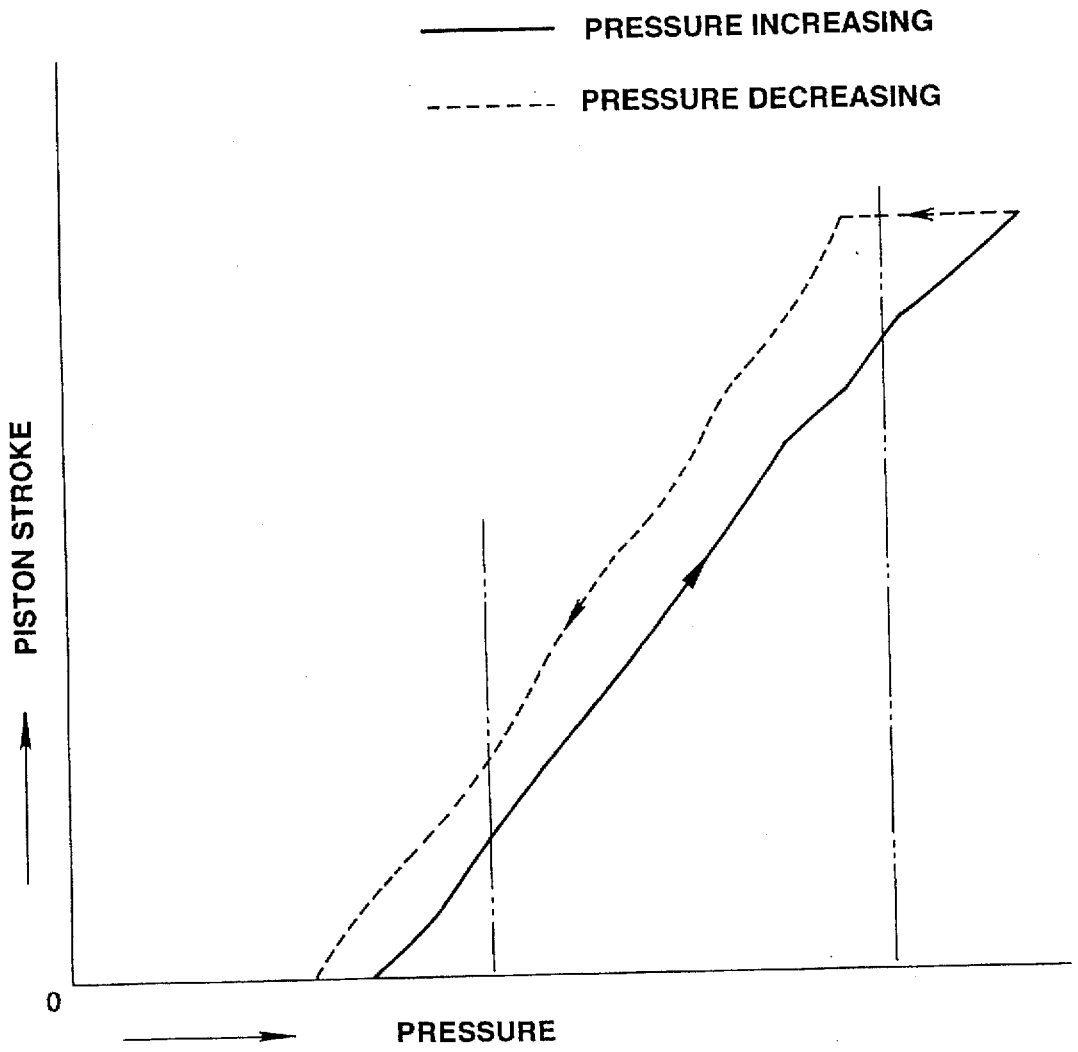
FIG. 7 is a graph showing the characteristic of the cylinder type actuator in terms of the relationship between a pressure fed to the actuator and a piston stroke of the actuator.

The stroke characteristic of the piston rod 11*d* with respect to the magnitude of the pressure fed to the actuator 11 is shown in the graph of FIG. 7. As is seen from this graph, the stroke characteristic of the piston rod 11*d* obtained when the pressure in the work chamber 11*a* is increasing is different from that of the piston rod 11*d* obtained when the pressure in the work chamber 11*a* is decreasing. That is, the stroke of the piston rod 11*d* has a certain hysteresis between the pressure increasing mode and the pressure decreasing mode of the actuator 11. The is because of an inevitable friction of the piston 11*b* against the inner wall of the casing 11*f* of the actuator 11. Accordingly, when the pressure in the work chamber 11*a* varies within a small range, the hysteretic pressure range can serve as a damping zone and thus the undesired hunting of the valve assembly 12, which would occur when the butterfly plate 12*a* makes the opening and closing movement, can be eliminated.

Since the tapered open end 13 of the pressure induction pipe 10 is arranged to face the rear open end of the exhaust gas inlet tube 4, the pipe 10 can catch the dynamic pressure of the exhaust gas as well as the static pressure of the same. This means a certain increase in pressure level of the positive pressure fed to the actuator 11, and thus the valve actuating operation of the actuator 11 is assured.

PRESSURE REGULATING FUNCTION

Under operation of the engine, the exhaust gas is discharged from the engine with a certain pressure fluctuation varied in accordance with the speed of the engine. Thus, if such exhaust gas is directly fed to the work chamber 11*a* of the actuator 11 to operate the same, the movement of the piston rod 11*d* would be severely affected by the pressure fluctuation. In fact, the opening and closing movement of the butterfly plate 12*a* of the valve assembly 12 would be severely fluctuated in such case.

However, in case of the controllable exhaust system to which the present invention is applied, such apprehension is eliminated by positioning the tapered open end 13 of the pressure induction pipe 10 at the interior of the muffler 1. As is known, when the exhaust gas is led into the muffler 1, the pressure fluctuation of the same is reduced and thus regulated. This pressure regulating function becomes most effective when the engine is under a low speed operation. If a thinner pressure induction pipe is used, much regulated positive pressure can be obtained from the exhaust gas.

OPERATION OF VALVE ASSEMBLY 12 UNDER ACCELERATION OF ENGINE

When, for accelerating the vehicle, the accelerator pedal is depressed and thus the speed of the engine increases, the pressure of the exhaust gas is increased. With this, the positive pressure in the muffler 1 and thus the pressure in the work chamber 11*a* of the actuator 11 is increased. Thus, the butterfly plate 12*a* of the valve assembly 12 is turned from the fully closed position toward the fully opened position. Since the turning of the butterfly plate 12*a* is continuously or steplessly carried out, smoothed acceleration of the vehicle as well as ear-agreeable exhaust sound are obtained.

Figure 8:
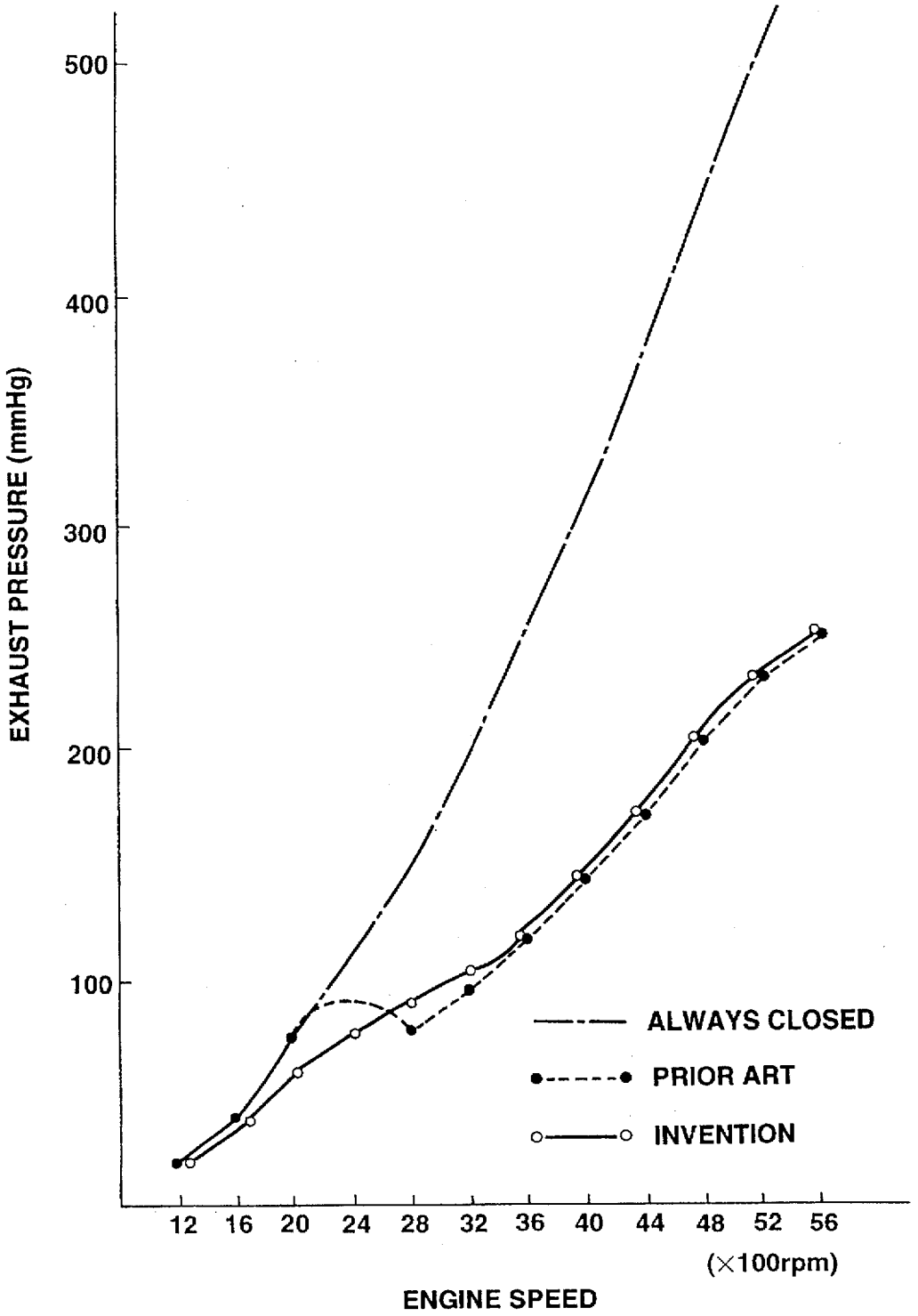
FIG. 8 is a graph showing both an exhaust pressure control performance exhibited by the muffler controller of the invention and that exhibited by a conventional muffler controller, the performance being depicted in terms of the relationship between a static pressure of the exhaust gas and an engine speed.
Figure 9:
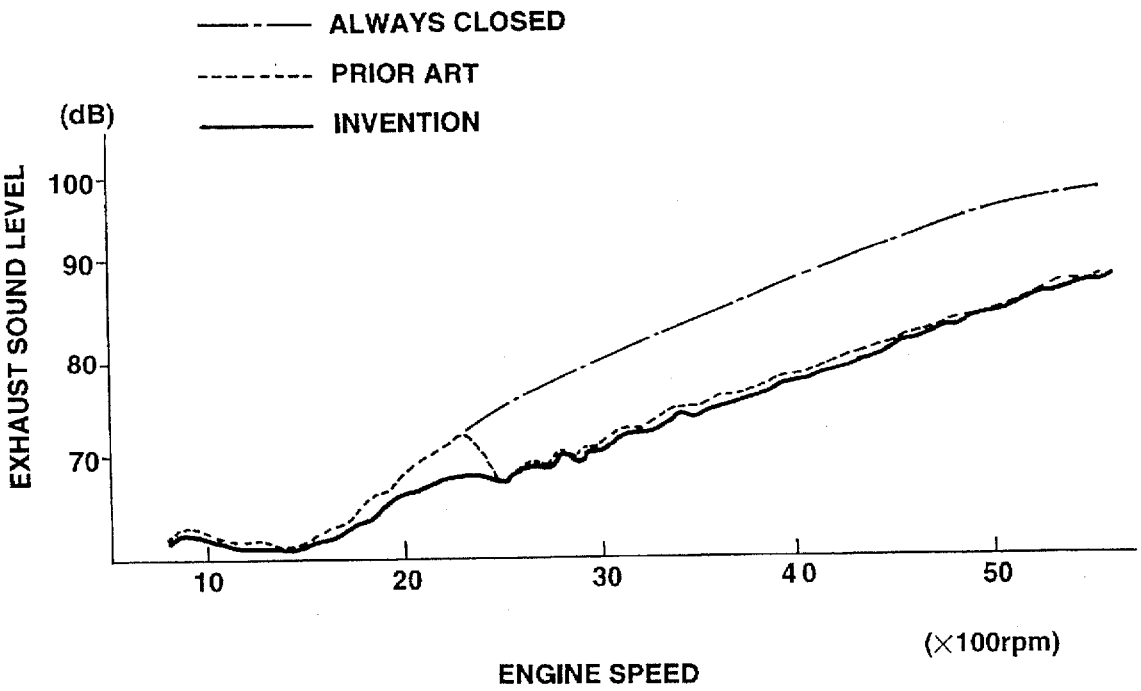
FIG. 9 is a graph showing both an exhaust sound control performance exhibited by the muffler controller of the invention and that exhibited by the conventional muffler controller, the performance being depicted in terms of the relationship between an exhaust sound and the engine speed.
Figure 10:
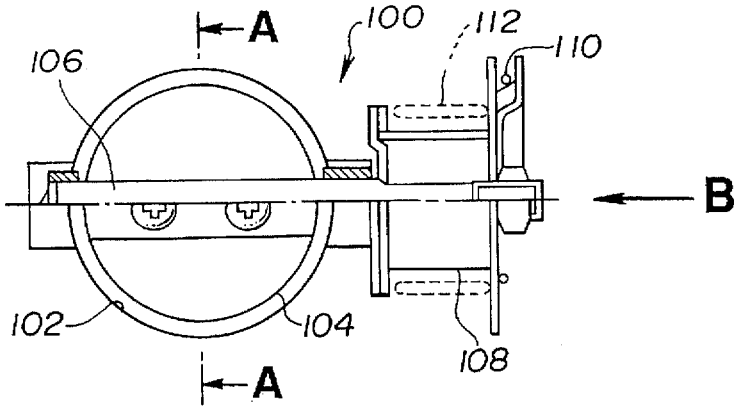
FIG.10 (PRIOR ART)
FIG. 10 is a sectional view of a valve assembly employed in a conventional muffler controller.
Figure 11:
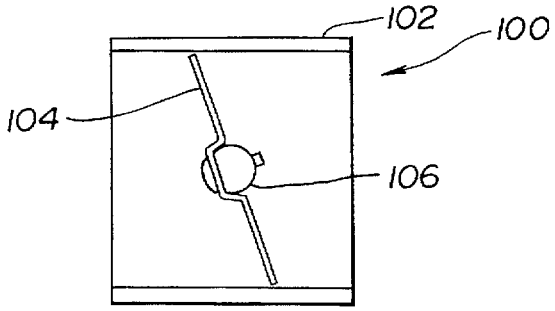
FIG.11 (PRIOR ART)
FIG. 11 is a sectional view taken along the line A—A of FIG. 10.

These advantageous phenomena will be readily understood from the graphs of FIGS. 8 and 9.

FIG. 8 shows both an exhaust pressure control performance exhibited by the controllable exhaust system to which the invention is applied and that exhibited by a conventional controllable exhaust system. In the conventional exhaust system, an ON/OFF type control valve is employed, which controls a valve proper in ON/OFF manner, so that the valve proper takes only a fully closed position and a fully open position.

As is seen from this graph, in the conventional controllable exhaust system (whose characteristic is depicted by the curve of dotted line), the exhaust static pressure is suddenly but temporarily dropped at a certain engine speed (viz., about 2400 rpm) during the time when the engine speed is increasing. The sudden drop is produced when the valve proper changes its position from the fully closed position to the fully open position. Of course, in this case, smoothed acceleration of a vehicle is not expected. However, in the controllable exhaust system to the present invention is applied (whose characteristic is depicted by the curve of solid line), such undesired pressure drop does not appear. This is because of usage of the steplessly openable butterfly plate 12*a* of the valve assembly 12. As has been described hereinabove, the butterfly plate 12*a* can vary the open degree in the second exhaust gas outlet tube 8. That is, with increase of engine speed, the exhaust static pressure increases substantially linearly, and due to the gradually opening movement of the butterfly plate 12, the exhaust resistance is gradually decreased, which provides the vehicle with a smoothed acceleration.

The curve illustrated by a phantom line shows a case wherein the butterfly valve 12*a* (or valve proper) is kept closed throughout the increase in engine speed.

FIG. 9 shows both an exhaust sound controlling performance exhibited by the controllable exhaust system to which the invention is practically applied and that exhibited by the conventional controllable exhaust system.

As is seen from this graph, in the conventional controllable exhaust system (whose characteristic is depicted by the curve of dotted line), the exhaust sound is suddenly but temporarily dropped at the certain engine speed (viz., about 2400 rpm) during increase in engine speed. This sound drop is not agreeable to the ear. However, in the controllable exhaust system to which the present invention is applied (whose characteristic is depicted by the curve of solid line), such undesired sound drop does not appear. Thus, ear-agreeable exhaust sound is obtained.

The curve illustrated by a phantom line shows a case wherein the butterfly valve 12*a* (or valve proper) is kept closed throughout the increase in engine speed.

APPLICATION TO MOTOR VEHICLE

In the controllable exhaust gas to which the present invention is practically applied, the exhaust gas from the engine is used as a power for driving the valve assembly 12. Thus, the exhaust system can be manufactured at low cost as compared with other exhaust systems in which electric actuators are used for actuating the control valve.

Advantages of the muffler controller of the present invention will become apparent from the following description.

OPERATION OF VALVE ASSEMBLY 12

When, as is seen from FIG. 3, the butterfly plate 12*a* of the valve assembly 12 assumes its fully closed position, the roller 18 rotatably mounted on the piston rod 11*d* of the actuator 11 is in abutment with the outer end 17*c* of the elongate slot 17 of the operation disc 16. Thus, the butterfly plate 12*a* can be kept in the fully closed position without play.

When, due to operation of the actuator 11, the piston rod 11*d* starts to move in a direction to open the butterfly plate 12*a*, the roller 18 starts to move in the elongate slot 17 toward the inner end 17*b* of the slot 17. During this, the roller 18 (see FIGS. 6A–6B) moves along the straight-way "SL" which is offset from the center "O" of the operation disc 16 by the distance "L".

When coming to a half position of the straight-way "SW", the roller 18 is brought into contact with the inner end 17*b* of the elongate slot 17 pivoting the butterfly plate 12*a* by 45 degrees in angle from the fully closed position. Thus, the butterfly plate 12*a* takes a half open position in the second exhaust gas outlet tube 8.

When moving further along the straight-way "SW" in the same direction, the roller 18 moves in the elongate slot 17 toward the outer end 17*c* of the slot 17. During this, the open degree of the butterfly plate 12*a* gradually increases from the half open position.

When the roller 18 comes to the farmost position of the straight-way "SW", the same is brought into contact with the outer end 17*c* of the elongate slot 17 causing the butterfly plate 12*a* to take the fully opened position. Because of the contact of the roller 18 with the outer end 17*c* of the slot 17, the butterfly plate 12*a* can be kept in the fully opened position without play.

Figure 12:
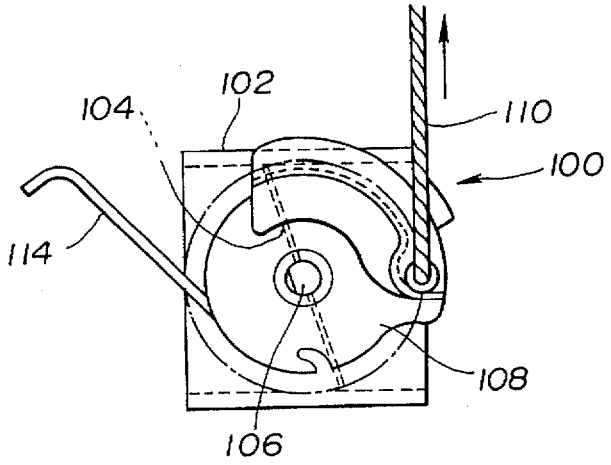
FIG.12 (PRIOR ART)
FIG. 12 is a view taken from the direction of the arrow "B" in FIG. 10.

Since the fully closed condition of the butterfly plate 12*a* is induced by the abutment between the roller 18 and the outer end 17*c* of the elongate slot 17, the undesired valve-holding phenomenon, which has been mentioned in the prior art section, is eliminated or at least minimized. Due to the same reason, there is no need of using any stopper, such as the stopper 114 (see FIG. 12) employed in the conventional muffler controller, for stopping the butterfly plate 12*a* at the fully opened position.

Due to usage of the roller 18 whose diameter is somewhat smaller than the breadth of the elongate slot 17, the movement of the roller 18 in the slot 17 can be made smoothly. In fact, as will be seen from FIG. 5, under the projecting stroke of the piston rod 11*d* of the actuator 11, the roller 18 rolls on the far side of the wall of the slot 17, and under the retracting stroke of the piston rod 11*d*, the roller 18 rolls on this side of the wall. Thus, the pivoting movement of the butterfly plate 12*a* can be smoothly carried out.

FUNCTION OF SPRING 11*c* OF ACTUATOR 11

The critical pressure at which the actuator 11 starts the opening operation of the valve assembly 12 (viz., butterfly plate 12*a*) is determined by the biasing spring 11*c* installed in the actuator 11. As has been mentioned hereinabove, in a rest condition of the engine, the valve assembly 12 fully closes the flow passage of the second exhaust gas outlet tube 8 due to the force of the biasing spring 11*c*. This means that the biasing spring 11*c* constitutes a part of a so-called "fail safe system". That is, if, due to breakage of the pressure induction pipe 10 or the like, the work chamber 11*a* of the actuator 11 fails to receive a satisfied positive pressure, the butterfly plate 12*a* is forced to take the fully closed position by the function of the biasing spring 11*c*. In the present invention, the biasing spring 11*c* is installed in the casing 11*f* of the actuator 11, which means protection of the spring 11*c*.

In the following, modifications of the present invention will be described.

If desired, in place of the above-mentioned cylinder type actuator 11, a diaphragm type actuator and a servo-motor assisted actuator may be employed so long as they can actuate the valve assembly 12 in accordance with the exhaust pressure created in the muffler 1.

If desired, a negative pressure created by using the exhaust gas flowing in the muffler may be used for driving the actuator 11. Furthermore, the pressure induction pipe 10 may be connected to the exhaust gas inlet tube 4. However, in this case, the above-mentioned pressure regulating function is not expected.

What is claimed is:

1. A muffler assembly installed in an exhaust system of an internal combustion engine, comprising:

a muffler;

a conduit operatively connected to said muffler and defining an exhaust gas flow passage through which the exhaust gas in said muffler flows before discharging to the open air;

an actuator operatively connected to said conduit and having a piston rod moving straightly and reciprocatively in accordance with an exhaust pressure in said muffler; and a valve assembly operatively connected to said conduit and including:

a valve plate pivotally installed in said exhaust gas flow passage by a pivot shaft;

an operation disc coaxially connected to said pivot shaft to rotate together with said pivot shaft and said valve plate;

a radially extending elongate slot defined in said operation disc; and a roller rotatably connected to said piston rod and slidably received in said elongate slot.

2. In a controllable exhaust system of an internal combustion engine including an exhaust gas inlet tube extending from said engine, a muffler connected at its inlet side to said exhaust gas inlet tube and having first and second exhaust gas flowing passages defined therein, and first and second exhaust gas outlet tubes respectively connected to said first and second exhaust gas flowing passages and extending from said muffler independently, a muffler controller operatively connected to said second exhaust gas outlet tube for varying a flow passage area of said second exhaust gas outlet tube in accordance with a pressure of an exhaust gas entering the muffler from the engine, said muffler controller comprising:

an actuator operatively connected to said second exhaust gas outlet tube and having a piston rod moving straightly and reciprocatively in accordance with a magnitude of the exhaust pressure in said muffler; and a valve assembly operatively connected to said second exhaust gas outlet tube and including a valve plate, a pivot shaft through which said valve plate is pivotally installed in said second exhaust gas outlet tube, an operation disc coaxially connected to said pivot shaft to rotate together with said pivot shaft and said valve plate, an elongate slot defined in said operation disc and extending radially with respect to a center of said operation disc, and a roller rotatably connected to said piston rod and slidably received in said elongate slot.

3. A muffler controller as claimed in claim 2, wherein a diameter of said roller is smaller than a width of said elongate slot.

4. A muffler controller as claimed in claim 2, further comprising a pressure induction pipe through which the pressure in the muffler is fed to said actuator.

5. A muffler controller as claimed in claim 2, wherein said piston rod moves in a direction perpendicular to an axis of said pivot shaft.

6. A muffler controller as claimed in claim 2, wherein when said piston rod assumes a retracted position, said roller abuts an outer end of said elongate slot, moving the valve plate to a fully closed position and when said piston rod assumes a projected position, said roller abuts said outer end of said elongate slot, moving the valve plate to a fully opened position.

7. A muffler controller as claimed in claim 6, wherein when said piston rod assumes in intermediate position between said retracted position and said projected position, said roller abuts an inner end of said elongate slot.

8. A muffler controller as claimed in claim 2, wherein said actuator comprises:

a cylinder casing;

an annular piston slidably received in said casing and defining a work chamber into which the exhaust pressure in said muffler is fed to move said annular piston in a first direction, said piston rod being connected to said annular piston and moving therewith; and a coil spring for biasing said annular piston in a direction opposite said first direction.

* * * * *